United States Patent [19]

Biller et al.

[11] Patent Number: 4,735,327

[45] Date of Patent: Apr. 5, 1988

[54] RADIO CONTROLLED DOWNHILL SKYLINE LOGGING CARRIAGE AND SYSTEM

[75] Inventors: Cleveland J. Biller, Morgantown; David D. Johnson, Booth, both of W. Va.

[73] Assignee: The United States of America as represented by the Secretary of Agriculture, Washington, D.C.

[21] Appl. No.: 868,484

[22] Filed: May 30, 1986

[51] Int. Cl.[4] ..... B66C 21/00

[52] U.S. Cl. ..... 212/92; 212/87; 212/89

[58] Field of Search ..... 212/76, 82, 83, 85, 212/87, 89, 92, 148, 207

[56] References Cited

U.S. PATENT DOCUMENTS

| | | | |
|---|---|---|---|
| 1,342,217 | 6/1920 | Hensel et al. | 212/79 |
| 1,365,982 | 1/1921 | Graham | 212/207 |
| 1,565,454 | 4/1923 | Hoisington | 212/76 |
| 2,547,935 | 4/1951 | Grabinski | 105/155 |
| 3,022,747 | 1/1959 | McIntyre | 104/178 |
| 3,083,839 | 4/1963 | McIntyre | 212/87 |
| 3,247,933 | 10/1964 | Hanna | 188/137 |
| 3,805,967 | 4/1974 | Sannell | 212/11 |
| 4,082,193 | 4/1978 | Teague | 214/2.5 |
| 4,109,799 | 8/1978 | Munn | 212/83 |
| 4,238,038 | 12/1980 | Fikse et al. | 212/89 |
| 4,347,938 | 9/1982 | Grosh | 212/121 |
| 4,355,727 | 10/1982 | Biller | 212/121 |
| 4,387,812 | 6/1983 | Biller et al. | 212/176 |
| 4,440,305 | 4/1984 | Biller | 212/90 |
| 4,515,281 | 5/1985 | Maki | 212/71 |

*Primary Examiner*—Joseph F. Peters, Jr.
*Assistant Examiner*—Thomas J. Brahan
*Attorney, Agent, or Firm*—M. Howard Silverstein; John D. Fado

[57] ABSTRACT

A skyline logging system which uses an improved carriage which can traverse intermediate supports, which can lift both ends of a load of logs, which has a telescoping center beam to accommodate different lengths of logs, which carries an on-board engine so that it is self contained as to power to haul logs up to the carriage, and which is radio controlled so that a man on the ground can perform all of the logging operations.

7 Claims, 4 Drawing Sheets

Carriage-Travel Empty Phase
Tail Tree
Intermediate Spars
Intermediate Support
Landing
Running Skyline Yarder Carriage-Winch in and Hook Choker Phase
Adjustable Open Sided Carriage
Intermediate Support Line
Winch Line Carriage-Travel Loaded Phase
Haulback Line
Mainline
Winch Line Carriage-in Unhook Phase

RADIO CONTROLLED DOWNHILL SKYLINE LOGGING CARRIAGE AND SYSTEM

FIELD OF THE INVENTION

This invention relates to skyline logging systems of the type employing a yarder and skyline attached thereto, with a suspended intermediate support to enable logs attached to a carriage to be moved on the skyline without coming into contact with the ground. More particularly, this invention relates to improvements in the carriages for use in such systems and to their mode of operation. Carriages according to the invention operate, when loaded, downhill, carry their own power source, and use gravity to bring the logs to the landing.

BACKGROUND OF THE INVENTION

Skyline logging systems are cable logging systems used to harvest timber from hillsides which are too steep for tractor logging. Skyline logging systems utilize a carriage similar to a trolley, to yard (move) logs from the location where they are felled to the landing (a location where the logs are concentrated for loading onto trucks). During the inhaul phase of the operation, one end of the log is carried above ground level. An intermediate support for the skyline may be employed where there is a rise or hump or other obstruction between the tree felling area and the location to which the logs are transported to provide the necessary ground clearance.

Logging over an intermediate support has been performed since the early part of the present century. Since its inception, it has been used with standing skyline systems. These are systems which operate with the skyline anchored at one end while the other end is held in position with a brake. Once the skyline is laid in the intermediate support and raised up into position, it does not move longitudinally in the support. Thus, in the previously employed systems the intermediate support engages a stationary line. The invention can also be used with such standing skyline systems.

In more modern systems, the skyline is used to support both the carriage and the turn of logs. These systems operate uphill with the yarder located at the top of the hill and the skyline extending downhill from the yarder. The carriage returns to the log hooking area by gravity where the carriage engages a stop on the skyline. The stop operates a lock in the carriage which releases the mainline and lets it fall to the ground. When it is desired to hook logs in a new location, the stop must be moved either up or down the skyline to the desired location, which is very time consuming. In this system, a ball is used to operate the carriage locking mechanism. The ball is held on the mainline with a steel pin, which in turn wears the line at its point of contact.

SUMMARY AND OBJECTS OF THE INVENTION

The carriage of the present invention is adapted for both live and standing skylines, and more particularly the invention carriage is adapted to downhill cable logging systems. The present invention includes means to allow the carriage to cross an intermediate support smoothly, and to allow longitudinal movement of the skyline during the yarding cycle. In a live skyline logging system, such longitudinal movement normally occurs during the loading and unloading phases. In a standing skyline system, the skyline will be slackened at the beginning and at the end of harvesting a skyline corridor. In addition, the skyline will be slackened at any time the carriage malfunctions so that maintenance can be performed on the carriage.

Accordingly, the invention provides a novel and improved carriage for all of the conventional types of skyline cable systems which overcomes the deficiencies and disadvantages of carriages previously used in such systems.

An object of the invention is to provide an improved skyline logging carriage and cooperating intermediate support structure for a skyline logging system which overcomes the deficiencies and disadvantage of the carriage and support structures heretofore employed.

A further object of the invention is to provide an improved skyline logging carriage and an intermediate support structure cooperable with the carriage to allow smooth passage of the carriage over the support, and to permit such smooth passage when the carriage is tilted or is swinging traversely while moving over the intermediate support.

Another object of the invention is to provide an improved skyline logging system including a carriage and an intermediate support structure wherein the loaded carriage operates downhill with the help of gravity, to thus require a smaller yarder as compared to uphill yarder logging systems.

Yet another object of the invention is to provide an improved skyline logging carriage which lifts both ends of a load of logs thereby permitting the entire system to be lower to the ground which is advantageous in building a logging system.

A still further object of the invention is to provide an improved skyline logging carriage which includes a telescoping center beam or main support which is adjustable to permit the carriage to accommodate different lengths of logs.

Another object of the invention is to provide an improved skyline logging carriage which has independently operated radio controlled clutches to activate the winches which power the cables at each end of the carriage.

A still further object of the invention is to provide an improved skyline logging carriage which has an engine onboard so that it is self-contained as to power for the two winches.

Yet another object of the invention is to provide an improved skyline logging carriage which is radio controlled, whereby a man on the ground can remotely control the carriage on the skyline during logging operations.

Further objects and advantages of the invention will become apparent from the following description and claims, and from the accompanying drawings also forming a part of this disclosure, wherein:

DESCRIPTION OF A PREFERRED EMBODIMENT

Figures 1, 2, 3, 4:
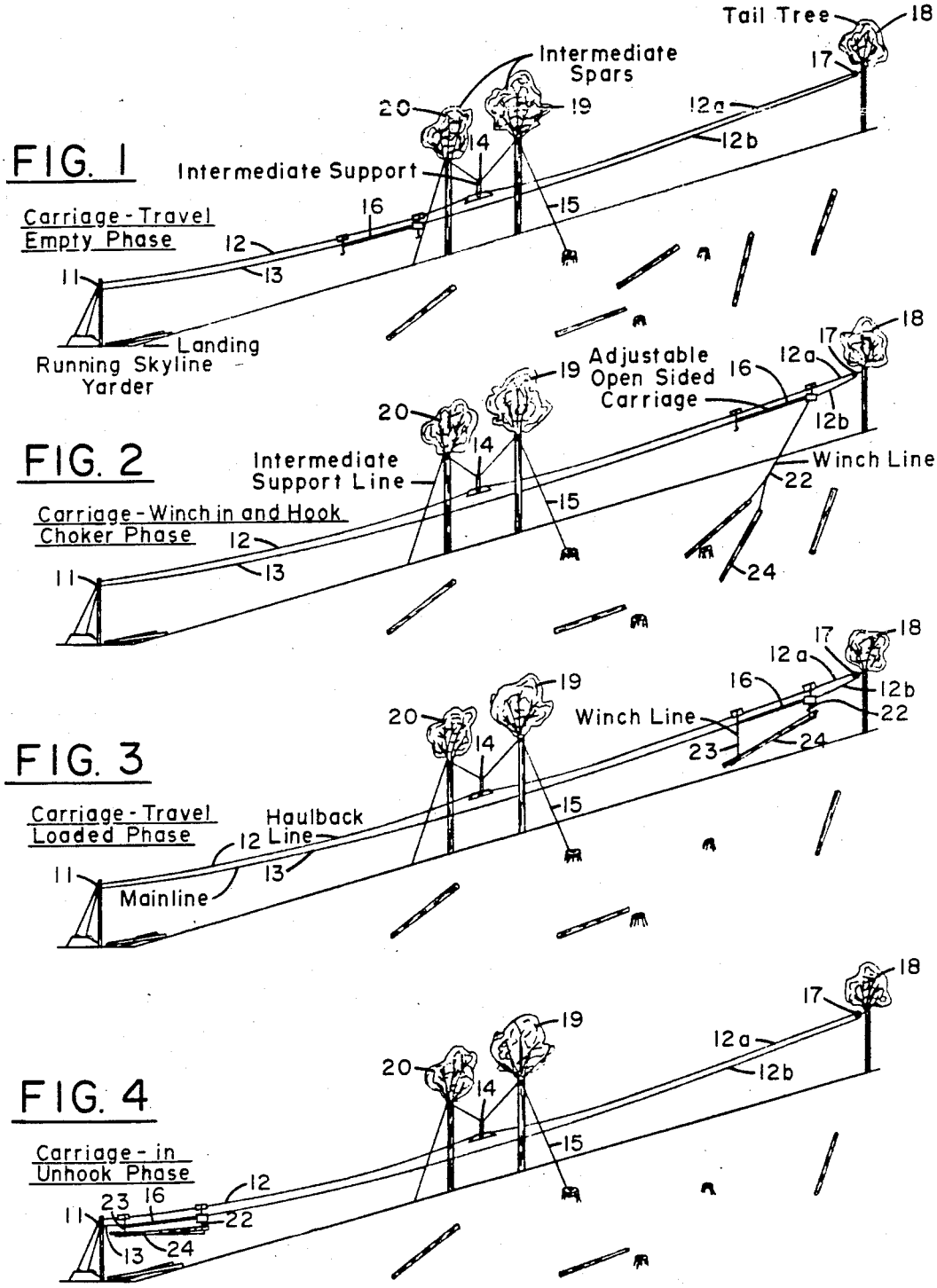
FIG. 1 is a schematic illustration of a multi-span downhill logging system employing an improved carriage and intermediate support structure according to the present invention, the carriage being shown in the uphill travel while empty phase of the logging cycle.
FIG. 2 shows the system of FIG. 1 in the lateral hook load and winch phase of the logging cycle.
FIG. 3 shows the system of FIG. 1 in the downhill travel while loaded phase.
FIG. 4 shows the system of FIG. 1 in the unloading phase of the logging cycle.

Referring now to the drawings in detail, FIG. 1 diagrammatically illustrates a multi-span, downhill running skyline logging system, which employs a yarder 11 with rigging including a haulback line 12, and a mainline 13. The haulback line 12 extends over an intermediate support assembly 14 located at a suitable position between the yarder 11 and a tailtree or other anchor means 18. In the illustrated system, the haulback line extends around a sheath 17 which is anchored to the tailtree 18. The upper and lower haulback lines segments 12*a* and 12*b* are supported on sheave 17. The lower haulback line 12*b* is connected to an adjustable open sided carriage 16 movably supported on the upper haulback line 12*a*, see FIG. 10.

The intermediate support assembly 14 may be suspended from a support line 15 connected to and supported on a pair of intermediate spar trees 19 and 20. These trees 19 and 20 are selected to be suitably located on opposite sides of the haulback and other rigging lines at any region requiring extra height of the skyline, for example, at a hump or rise or to make the span longer between the yarder 11 and the tailtree 18. More than one such intermediate support could be provided in logging systems embodying the invention.

Referring to FIGS. 1, 2, 3 and 4, the carriage 16 is shown in various phases of one complete logging cycle. In FIG. 1, the carriage 16 is being pulled uphill on the haulback line 12 by the yarder 11. The yarder 11 will need only relatively little and sufficient horsepower to return the carriage 16 at a desired speed since the yarder 11 is pulling only at empty carriage 16. The yarder 11 must have a good braking system on line 12 so that it can control the carriage 16 and load in the downhill travel loaded phase of FIG. 3. In FIG. 2, the carriage 16 is yarding logs from the stumps to the carriage with winch line 22 which is independently radio controlled by the chokersetter. In FIG. 3, upon arrival of the load 24 at the carriage 16, winch line 23 is attached to the logs by the chokersetter and the ends of the logs 24 are raised in the air to clear obstacles such as humps in the skyline path. Winch line 23 is also independently radio controlled. In FIG. 4 the carriage 16 is returned to the yarder 11 by moving down the haulback line 12, requiring very little horsepower and primarily only the braking capacity of yarder 11. The two winch lines 22, 23 are slackened and the load 24 is thus lowered to the ground where the chokers are unhooked and the cycle is repeated.

The present invention is applicable to use with all sorts of different skyline systems. In the system shown in FIGS. 1-4, the haulback line and mainline are both connected directly to the carriage. Thus, the two lines 12 and 13 together with the carriage made a closed loop between the yarder 11 and the tailtree 18. Other system with which the invention can be used include the standing skyline system, wherein a line is provided which is fixed in place and on which the carriage rides, and other lines are provided to move the carriage along the standing line.

The invention carriage may be used with all sorts of skyline systems, and in addition can be used in such systems where they include an intermediate support.

Another facet of the invention is that it is a downhill logging system. This means that the engine in the yarder 11 can be of significantly lower horsepower than uphill logging systems wherein the yarder engine must pull the full weight of the load. In the present invention, gravity moves the load from the collection upper end of the hill to the unloading end at the bottom of the hill, at the location of the yarder.

Another advantage in this regard is that since the carriage lifts both ends of the logs, the logs are stacked neatly in a pile at the foot of the yarder, see the left hand side of FIG. 4. This neat piling of the bundles of logs as they come down the hill is an important advantage of the invention in that it greatly facilitates loading of the logs onto trucks or the like for further processing. This provides significant economic advantages for the invention system.

Downhill logging systems are known in the prior art, but they are extremely cumbersome, or difficult to rig up in the hilly logging terrains in which the present invention is used, and they are considerably more complicated overall than the invention systems. Most hillside logging systems in use to date operate with relatively large horsepower yarders in order to obtain speed on the movement of the carriage across the logging system. Since, in the present invention, the yarder engine uses it power to move only an empty carriage, much higher speed can be obtained with a relatively smaller engine. The on-board engine on the carriage is used to haul the logs to the carriage for later logging downhill. Finally, the actual downhill delivery of the bundle of logs is accomplished primarily with the force of gravity, and is thus done at whatever high speed is desired, the yarder engine braking system being used primarily to simply control the downhill run of the bundle of logs and the carriage. Since the carriage engine does the relatively light work of pulling in only a few logs at a time, it can be relatively small. Further, gearing is provided as described below so that sufficient force is available to haul or pull the logs from the sites at which they are cut to the carriage on the skyline. In conventional systems, the yarder engine, acting through the entire skyline system, must have sufficient power not only to provide the relatively fast speed of motion of the carriage up and down the skyline system, but also to provide the energy to the cable used to pull the logs from the stumps to the carriage. This further increases the necessary power of such relatively large prior art yarder engines.

Further, the invention is not limited to use in timber harvesting, but also, for example, in the construction industry. Skyline systems are often used to move equipment and materials to a building site, for example, to move concrete to a pouring area for a dam. In such cases, intermediate supports are also provided in order to provide the necessary added height so that the load can traverse obstacles and the like.

Figure 5:
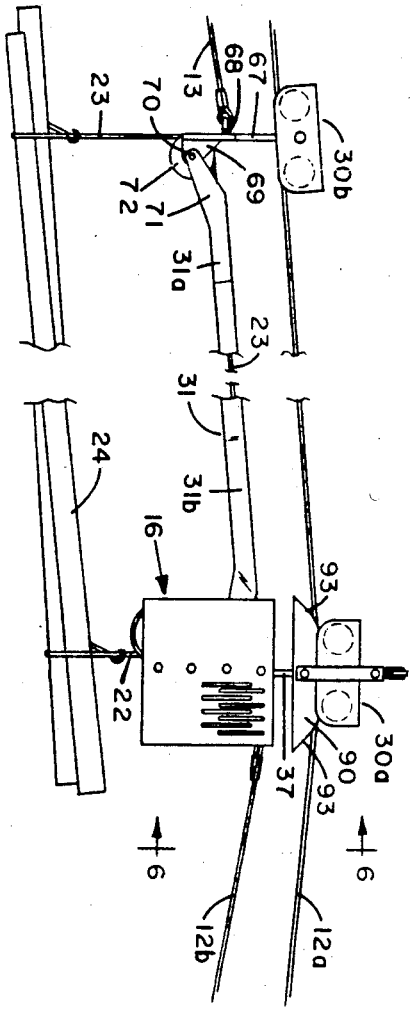
FIG. 5 is a side view, partly broken away, of the carriage and associated intermediate support structure according to the present invention as employed in the skyline logging system of FIGS. 1 to 4.
Figure 6:
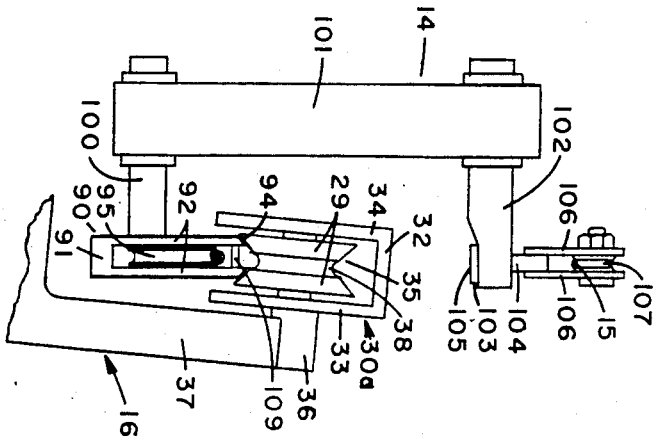
FIG. 6 is an enlarged traverse vertical cross-sectional view taken on line 6—6 of FIG. 5.
Figure 10:
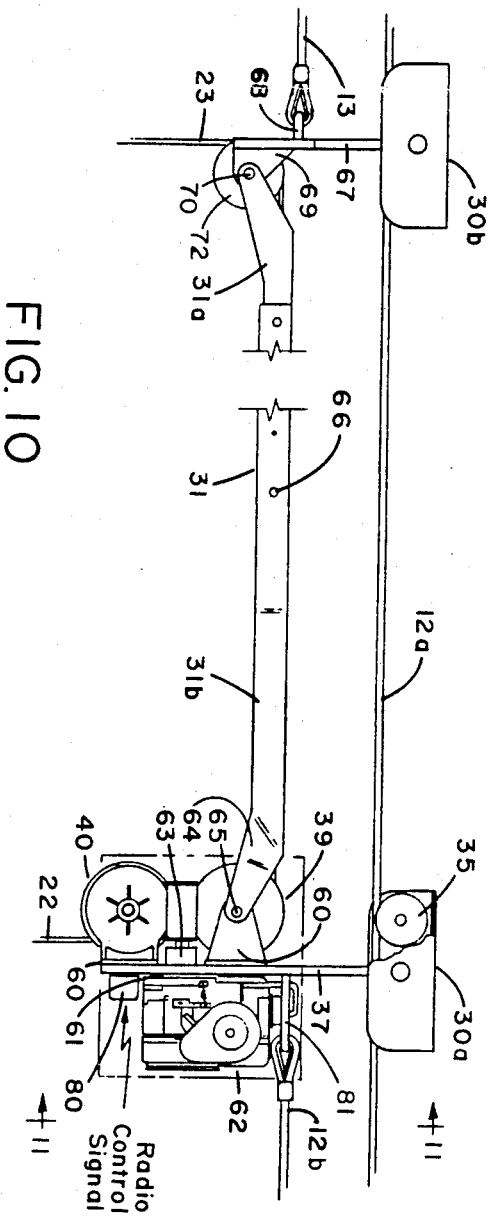
FIG. 10 is a view similar to FIG. 8 but showing the carriage in side elevation.

Referring now to FIGS. 5, 6 and 10, the carriage 16 comprises two sets of sheave wheels and support assemblies 30*a*, 30*b*, held apart by a telescoping center beam 31. Carriage support assembly 30*a* comprises a downwardly-facing channel-shaped main body having a top wall 32 and parallel depending side walls 33 and 34. Journalled between said side walls 33, 34, are respective peripherally grooved supporting wheels or pulleys 35 (two pulleys 35 on each assembly 30*a* and 30*b*), normally supportingly engaged on the upper haulback line 12*a*, as shown in FIGS. 1 to 4.

Figure 7:
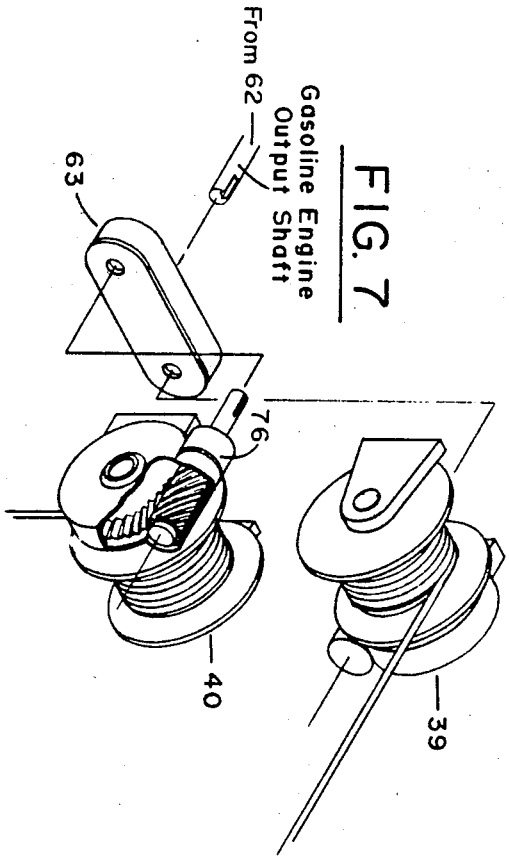
FIG. 7 is a partial, diagrammatic, exploded, perspective view showing the two worm gear drive winches and radio controlled reversing gearbox on the carriage.
Figure 8:
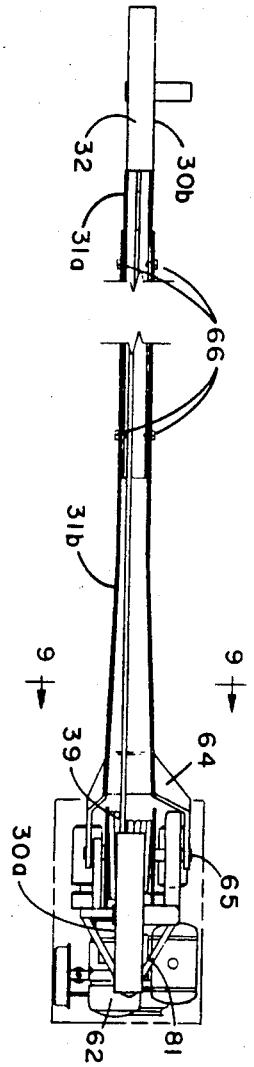
FIG. 8 is a somewhat diagrammatic partially broken away top view of the carriage of the system of FIGS. 1-4.
Figure 9:
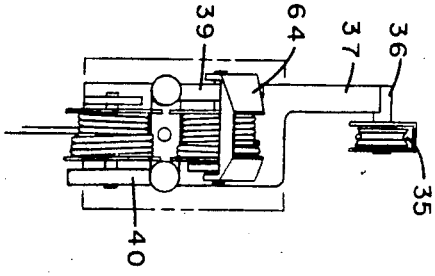
FIG. 9 is a traverse vertical cross-sectional view taken substantially on line 9—9 of FIG. 8.
Figure 11:
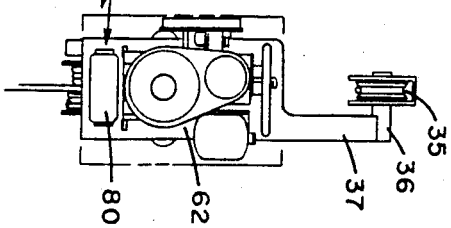
FIG. 11 is a traverse vertical cross-sectional view taken on line 11—11 on FIG. 10.

Depending top link shafts 36 are rotatably secured to intermediate portions of side walls 33, 34 of assembly 30*a*. A formed main support member 37 is rigidly secured to the top link shaft 36 of assembly 30*a*, with the support member 37 formed so as to provide an inward offset sufficient to make the plane of symmetry substantially the same as that of the center plane of the peripheral grooves 38 of pulleys 35 as shown in FIGS. 6, 9 and 11. "U" shaped members 60 are rigidly secured to the main support 37 and worm gear driven winches 39, 40 are rigidly secured to these members 60. Worm gear which 40 powers winch line 22 and worm gear winch 39 powers winch line 23. A plate 61 is rigidly secured to the member 37 with a gasoline engine 62 rigidly secured to side plate 61. Referring to FIGS. 7, 10 and 11, gasoline engine 62 transmits power through a radio controlled reversing gear box 63, which in turn transmits power to the worm gear winches 39, 40. A pair of spaced side plate members 64 are rotatably secured to the worm gear winch 39, see FIGS. 8, 9 and 10. The telescoping center beam 31*b* is rigidly secured to plate members 64 with about shaft collars 65. The telescoping center beam 31 is made up of two components 31*a*, 31*b*, with beam component 31*a* sliding inside beam component 31*b* for adjustment of beam 31 to different log lengths. Beam 31 is held in adjusted position with four bolts 66 which fit through holes in telescoping center beam component 31*b* and which thread into beam component 31*a*, as shown in FIGS. 8 and 10.

Depending top link shaft 36 is rotatably secured to the intermediate portion of side walls 33 and 34 of assembly 30*b*. Main member 67 is rigidly secured to the top link shaft 36 of assembly 30*b* as shown in FIG. 6, with the support member 67 formed to provide an inward offset sufficient to make the plane of symmetry substantially the same as that of the center plane of the peripheral grooves 38 of pulley 35, as shown in FIG. 6, and as is the case with assembly 30*a*. An eye member 68 is rigidly secured to the member 67, and said eye 68 has the mainline 13 secured in a conventional manner some distance below the carriage support sheave wheels 35 and carriage support assembly 30*b*. A pair of side plates 69 are rigidly secured to member 67, and said side plates 69 are piviotally secured to the telescoping center beam component 31*a* with a bolt 70. Bolt 70 penetrates the telescoping center component 31*a* which is formed at its end as a channel member 71 (see FIG. 5), through which the bolt 70 passes. Between the arms of channel member 71 is a sheave 72 whereby winch line 23 passes to attach to one end of the load 24. Said bolt 70 passes through sheave 72 to allow a movable connection, as shown in FIGS. 5 and 10.

A V-shaped member 81 is rigidly secured to the plate 61. Attached to the V-shaped member is the lower element of the haulback line 12*b*, as shown in FIG. 10.

Referring now to FIGS. 6, 9 and 10, the top part of the carriage support assembly 30*b* is similar to the corresponding part of assembly 30*a* described above and also comprises a downwardly-facing channel shaped main body having a top wall 32 and parallel depending side walls 33 and 34. Journalled between said end portions are respective peripherally grooved supporting pulleys 35 normally supportingly engaged on the upper haulback line 12*a*, as shown in FIG. 6. Assembly 30*b* includes a main member 67 which corresponds to main member 37 of assembly 30*a*.

The peripherally grooved carriage supporting pulleys 35 are formed with inwardly tapering frustoconical treat surfaces 29 located symmetrically on opposite sides of the peripheral grooves 38, as shown in FIG. 6. The carriage support assemblies 30*a*, 30*b* are rotatably secured to the intermediate portions of side walls 33, 34 at top link shafts 36, said top link shafts in turn being rigidly attached to the main members 67, 37.

Figure 12:
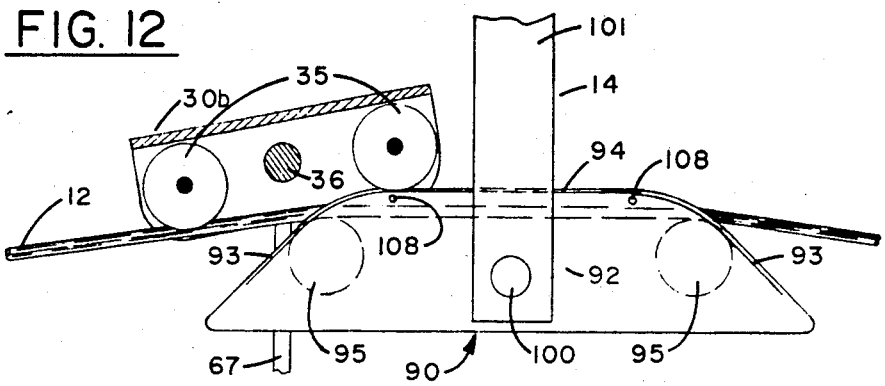
FIG. 12 is a partial side elevational view showing the carriage transversing the intermediate support.

Referring to FIGS. 6 and 12, the intermediate support assembly 14 comprises an upward facing supporting channel member 90 having a bottom wall 91 and upstanding spaced parallel side walls 92. A pair of pulleys 95 are rotatably mounted between the side walls 92. The channel member 90 is considerably longer than the carriage support assemblies 30*a* and 30*b* of the carriage 16, and the top edges of the side walls 92 have sloping opposite end ramp portions 93 leading to and smoothly merging with horizontal elongated main intermediate crest portions 94, see FIG. 12. Said top edges are upwardly and inwardly symmetrically bevelled substantially in conformance and to cooperate with the tapering tread surfaces 29 of the rollers 35, as shown in FIGS. 6 and 12. The overall width of the channel member 90 is substantially less than the traverse distance between the side walls 33, 34 of the channel member 30 of carriage 16 to allow for a substantial degree to angling of the carriage relative to the support 90, even while the carriage is in the act of transversing the intermediate support.

Journalled between the opposite end portions of the side walls 92 are the respective peripherally grooved pulleys 95 on which the haulback line 12*a* is engaged, as shown in FIG. 6. The pulleys 95 are located so that their top peripheral portions are spaced well below the level of the horizontal elongated crest portions 94 of the track surfaces whereby the cable is receivable between the top marginal portions of side walls 92 sufficiently below said elongated crest portions 94 to allow the carriage pulleys 35 to be elevated completely off of the cable 12 as the carriage 16 moves over the intermediate support channel member 90.

The channel member 92 is rotatably secured at its midportion to a traverse link pivot shaft member 100 which is rigidly secured to the lower end portion of a rectangular link bar 101. The top end of link bar 101 is rigidly connected to a top link shaft 102. As shown in FIG. 6, the top link shaft 102 is parallel to the bottom link shaft 100 and extends perpendicular to the longitudinal vertical central plane of channel member 90. The end portion of said top link shaft 102 is flattened at its bottom as shown at 103 and has a swivel aperture vertically aligned with channel 90 in which is disposed a swivel bolt 104 having an enlarged head portion 105 received in the recess defined by the flat portion 103. The shank of the swivel bolt 104 is welded between a pair of parallel plate like hanger bar members 106. A supporting sheave pulley 107 is journalled between the upper portions of hanger bar members 106 and is engaged on the intermediate support line 15.

In operation, as the carriage 16 reaches the intermediate support 14, for example, by being moved leftwardly and downhill from its positions of FIGS. 2 and 3, the left end carriage pulley 35 of assembly **30*b* engages on the right end ramp portion 93 of support channel 90. The leading or downhill end of the carriage 16 is then elevated onto the elongated crest portions 94 as it continues leftwardly. The carriage leading end thus now becomes disengaged from the haulback line portions 12*a*, and the haulback line is longitudinally movable freely relative to the carriage leading end thereby minimizing abrasion of the moving cable. As the carriage completes its passage leftwardly over the channel member 90, the support sheaves 35 again resume weight bearing and rolling contact on the haulback line 12. Of course, the same procedure occurs as the trailing carriage end assembly 30*a* traverses the intermediate support 14**.

Between the side walls 92 are respective bolts and bushings 108, 109 above the haulback line 12, as shown in FIGS. 6 and 12. The bolts and bushings 108, 109 keep the haulback line **12*a* from flipping off the intermediate support grooved pulley 95. The bolts and bushings 108, 109 also keep the bevelled side walls 92 from bending and hitting the grooved pulleys 95 when the carriage 16 and load cross the intermediate support 14**.

Radio controls to operate winches 39, 40 and other facilities of the carriage are incorporated into the control box 80. These radio controls operate electric clutches or the like in gear box 63 to cause reversing motion, and also operate independent clutches 76 (one only shown in FIG. 7) for powering out and powering in each of the cables 22 and 23.

It will be seen from the above description that the carriage assembly 16 and the cooperating intermediate support structure 14 can be readily adapted for use in many kinds of skyline systems, including systems wherein the skyline is moved relative to the intermediate support during some phase of the cycle. In such use, the carriage assembly described herein will pass the intermediate support with very little risk of abrasion of the skyline cable.

It will be seen from the above description that the carriage will lift both ends of a bundle or load of logs. This feature permits the entire system to be relatively low to the ground which is advantageous in building the system in that it allows longer skyline spans with fewer intermediate supports for clearance over obstacles or for longer span lengths. This feature keeps the logs cleaner and produces less wear and tear on the equipment used in processing the logs. In order for the carriage to lift both ends of the logs off the ground during the travel loaded phase, there is a telescoping center beam which is adjustable to permit the length of the carriage to accommodate different lengths of logs to be carried. Winch cable 23 for the leading end of the carriage passes through the center of the telescoping center beam and over a pulley 72, see FIG. 5.

The worm gear winches 39, 40 are independently operable with electric clutches 76 (see FIG. 7) that are radio controlled by the chokersetter or a man on the ground at the landing. The radio signal responsive clutch controls are in the control box 80. The radio signal sending unit is indicated by the legends and arrows on FIGS. 10 and 11.

The worm drive is an advantage because it tends to reduce the size of engine 62 and because it inherently acts as a brake on the respective cable when the respective clutch 76 is disengaged or the engine 62 is off.

The carriage is self-contained by having its own power source 62, thus giving it versatility to be used in both sawlog operations and pulpwood operations. The carriage delivers the load downhill using gravity primarily, thus requiring less horsepower to deliver a load of logs.

While the invention has been described in detail above, it is to be understood that this detailed description is by way of example only, and the protection granted is to be limited only by the spirit of the invention and the scope of the following claims.

We claim:

1. A skyline system for operation on sloping terrain comprising a yarder at the downhill end of the system, anchor means at the uphill end of said system, at least one intermediate support between said yarder and said anchor means; skyline cable means interconnecting said yarder, said anchor means and said at least one intermediate support; a carriage adapted to traverse said cable means, said carriage comprising means to permit said carriage to smoothly traverse said intermediate support even when said carriage is swinging laterally on said cable means, said carriage comprising a pair of winch means each of which is associated with one of fore end and aft end load hauling and lifting cables, said carriage comprising an on-board engine for powering said pair of winch means, remotely operable radio control means having portions thereof on said carriage for operating said pair of winch means by an operator located on the terrain in the vicinity of said skyline system, said yarder comprising a main engine for powering said interconnecting cable means, said main engine's size and power being selected such that they are relatively small and sufficient to power said carriage uphill at a predetermined speed only when said carriage is not carrying any load on its winch cables, and said pair of winch means comprising a pair of independently operated remote radio controlled clutch means, whereby each of said fore and aft load hauling and lifting cables can be operated up and down independently of the other using the power of said on-board engine.

2. The system of claim 1, said carriage comprising telescoping beam means interconnecting its fore and aft ends, whereby the length of said carriage can be adjusted to accommodate loads of different lengths.

3. The system of claim 2, said on-board engine and said pair of winch means being located at the aft end of said carriage, and said fore end load hauling and lifting cable passing thru said telescoping beam means from its said winch means to said fore end of said carriage.

4. The system of claim 1, said system comprising a logging system, said yarder comprising brake means to hold said carriage on said cable means at an inhaul position on said terrain while logs are collected on said terrain using said aft end load hauling and lifting cable and its associated winch means, said fore end load hauling and lifting cable being used together with said aft end load hauling and lifting cable to lift a bundle of thus collected logs up towards said carriage and off said terrain, one of said load hauling and lifting cables being positioned at each of the uphill and downhill ends of said bundle of collected logs, and said yarder brake means being used together with the force of gravity to deliver said thus raised bundle of logs from said collection area to the yarder end of said skyline.

5. The system of claim 1, said carriage comprising wheel means for cooperation with said skyline cable means, said intermediate support comprising means to cause said carriage to disengage from said skyline cable means and to pass onto said intermediate support, said intermediate support comprising pulley means to permit said skyline cable means to pass through said intermediate support below said carriage as said carriage passes on its wheel means over said intermediate support, and skyline cable retention means mounted on said intermediate support.

6. The system of claim 5, said means to cause said carriage to disengage comprising a pair of vertically disposed side plates forming part of said intermediate support and formed with carriage wheel treads at their upper edges.

7. The system of claim 6, said skyline cable retention means comprising bolt means extending between said side plates below their upper edges and above said cable means passing therethrough.

* * * * *